United States Patent [19]

Fleissner

[11] 4,059,974

[45] Nov. 29, 1977

[54] APPARATUS FOR THE CONTINUOUS TREATMENT OF ENDLESS MATERIAL, ESPECIALLY THE SHRINKING THEREOF

[75] Inventor: Hans Fleissner, Riehen, Switzerland

[73] Assignee: Vepa AG, Switzerland

[21] Appl. No.: 640,697

[22] Filed: Dec. 15, 1975

[30] Foreign Application Priority Data

| | | |
|---|---|---|
| Oct. 3, 1975 | Germany | 2544240 |
| Oct. 3, 1975 | Germany | 2544241 |
| Dec. 14, 1974 | Germany | 2459217 |
| Dec. 19, 1974 | Germany | 2460117 |

[51] Int. Cl.[2] ..... D06B 21/00; D06B 3/12; D06B 3/20

[52] U.S. Cl. ..... 68/15; 68/62; 68/158; 68/184; 68/DIG. 5; 226/104

[58] Field of Search ..... 68/15, 62, 9, 158, 175, 68/184, 181 R, DIG. 5, 5 D, 5 E, 178; 226/104–107; 34/157

[56] References Cited

U.S. PATENT DOCUMENTS

| | | | |
|---|---|---|---|
| 1,557,368 | 10/1925 | Kershaw et al. | 34/157 |
| 2,067,915 | 1/1937 | Haeberlin | 68/184 |
| 2,253,083 | 8/1941 | Mees et al. | 68/158 X |
| 2,534,054 | 12/1950 | Parkes | 226/105 X |
| 2,814,192 | 11/1957 | Brunner | 68/158 |
| 3,410,119 | 12/1968 | Fleissner | 68/158 X |
| 3,509,588 | 5/1970 | Fleissner | 68/DIG. 5 |
| 3,808,846 | 5/1974 | Fleissner | 68/DIG. 5 |
| 3,886,769 | 6/1975 | Conti | 68/62 X |
| 3,901,054 | 8/1975 | Meier-Windhorst | 68/181 R X |

FOREIGN PATENT DOCUMENTS

| | | | |
|---|---|---|---|
| 472,670 | 6/1952 | Italy | 68/184 |
| 613,364 | 12/1960 | Italy | 68/178 |
| 793,283 | 4/1958 | United Kingdom | 68/158 |

*Primary Examiner*—Philip R. Coe
*Attorney, Agent, or Firm*—Craig & Antonelli

[57] ABSTRACT

An apparatus for the continuous wet treatment of an endless material, such as a textile web, having a certain width and made of textured polyester fabric or knit, includes a vessel or container having a treatment liquor at a liquid level therein, an endless conveying means for transporting the endless material within the container in the form of suspended loops from an inlet to an outlet of the container, a partition vertically arranged within said container for defining a treatment chamber and a liquor recycling chamber separated from each other, said chambers being in communication with one another above as well as below the partition, means for producing liquid circulation from the treatment chamber to the liquor recycling chamber, the liquor being directed from the top portion of the treatment chamber to the bottom portion and then into the liquor recycling chamber, and take-off means arranged at the outlet of the container and being positioned at the liquid level whereby the endless material is transported through said container in a substantially tension-free manner to provide optimum shrinkage of the material therein.

22 Claims, 6 Drawing Figures

APPARATUS FOR THE CONTINUOUS TREATMENT OF ENDLESS MATERIAL, ESPECIALLY THE SHRINKING THEREOF

This invention relates to an apparatus for the continuous wet treatment, especially shrinking, relaxing and/or rendering bulky [puffing up] of endless material, such as textile webs having a certain width, made of, for example, textured polyester fabric or knit, this apparatus consisting of a container receiving the treatment liquor, passed through by an endless conveying means with supporting rods extending transversely across the operating width, on which the material is transported through the liquor in the form of suspended loops.

Wet treatment devices of this kind are used essentially for the shrinking of knit fabrics with at least partially synthetic fibers. The material is to be shrunk in order to compensate for thread tensions produced during the manufacture of the knit fabric within the material and in order to increase the volume of the product which has suffered from the tensile forces applied during the windup and also during the knitting step, in that the texture has been flattened. The relaxing and bulk development take place most rapidly and optimally during a guidance of the material under a low tension and under the effect of high temperatures provided, for example, by steam but more advantageously by water near the boiling temperature.

Furthermore, the material must be washed to remove the fatty, oily, or waxy preparations which are to increase the running properties of the threads during the texturing step, but also during the interlocking of the threads while the material is made into a hosiery- or knit-type fabric.

It is advantageous to combine the shrinking process with the washing step. Most advantageously, the shrinking step should be carried out first of all, but this ensues in a greater contamination of the shrinking bath, which must be heated to higher temperatures. The best solution is considered to be one wherein the material is first vigorously rinsed with cold water, then subjected to the shrinking process, and is finally subjected to the finishing washing step under low tension at moderate temperatures.

During the entire wet treatment procedure, a feature which must be primarily considered is the low-tension guidance of the material, in addition to the satisfactory efficiencies of the respective treatments, i.e. a good washing result and an optimum shrinkage. The above-indicated apparatus is distinguished by the advantageous, unimpeded guidance of the material, inasmuch as the loops of the material are freely suspended over the supporting rods in the liquor and/or the material is allowed to float, so that no external tension is exerted on the material during the wet treatment. However, precisely this guidance of the material leads to complications, since the large number of suspended loops, to attain the required dwell time, and also due to the high treatment temperature, float upwardly and jam at the supporting rods. This then leads to tensile stresses during the take-off of the material, which is hot and thus sensitive to tension; these tensile stresses at least partially reverse the desired shrinkage.

The invention is based on the objective of developing a machine plant for the washing, but especially shrinking operations wherein the material in total is guided under low tension, is washed clearly clean, and wherein a shrinkage is attained equal to the shrinkage obtained during boiling, namely while maintaining during the shrinking step an unimpeded guidance of the material, wherein the suspended loops freely float in dense positioning within the liquor and are freely conveyed during this process, but yet cannot get tangled.

Starting with an apparatus of the type mentioned in the foregoing, the invention provides, in order to solve the posed problem, that a treatment chamber and a liquor recycling chamber, separate from the former, are formed in the container by means of a vertically aligned partition arranged at a spacing from the outer wall of the container, these chambers being in communication with each other above as well as below the partition for a liquid circulation to be produced. Preferably, the partition is aligned in parallel to the operating direction of the endless conveyor, and such a liquor recycling chamber is provided on both sides of the treatment chamber.

The liquid current generated by means of a pump not only effects a uniform temperature distribution within the bath, but also is to influence the loops suspended from the supporting rods so that they cannot get tangled, especially so that they do not jam together with the supporting rods. For this purpose, the liquid flow within the treatment chamber should be directed from the top toward the bottom, and should merely have such a strength that the loops of material are freely suspended in the liquid from the supporting rods. The flow is not to exert any pulling force on the loops, since such force would already result in an incomplete shrinkage.

It can be advantageous to fashion the circulation power of the pump to be adjustable, for example so that the efficiency of the pump can be increased when the liquid has been brought to boiling and thus has a stronger tendency toward the opposite flow direction. In this way, an upward floating of the suspended folds can be avoided at any event.

The weak current of the liquor can be maintained at a uniform value across the length and width of the apparatus by covering the treatment chamber at the top by a liquid-permeable cover, such as, for example, a screen plate. It is advantageous to close off the treatment chamber also below the suspended loops by a liquid-permeable wall, wherein the latter should have a higher flowthrough resistance to limit the liquid current to the desired extent. It may even be desirable to dimension the flowthrough resistance of the perforated plate below the suspended loops to be so large that a second level is formed underneath the plate, in addition to the level formed above the screen cover.

A further constructional feature of the apparatus of this invention, very advantageous for the shrinking effect, resides in covering the container in a steamproof manner. This is the prerequisite for obtaining a high water temperature which should optimally attain the boiling point. However, precisely in case of boiling water there is the danger of an upward floating of the suspended loops, which is, however, prevented by the liquid current in accordance with this invention.

The feeding means for the heating medium is preferably provided in the liquor recycling chamber. Pipes passed through by a heating medium, or also devices which spray steam into the device can also be arranged underneath the treatment chamber, i.e. underneath the lower screen plate; however, less installations should be provided at that location than in the recycling chamber, since otherwise the heated and thus upwardly urged water would affect the suspended loops too greatly.

Another advantageous feature of the shrinking apparatus of this invention resides in the arrangement of a material take-off device at the outlet of the treatment chamber in the direct vicinity of the liquid level. This take-off device exerts merely a minor tension on the material to be withdrawn, because the material still floats in the liquid. Immediately adjacent thereto, it is advantageous to provide a cooling means, for example with cold water spraying devices to fix the volume of the material.

The essential feature during the treatment process is to be considered the maximally tension-free treatment of the endless material on a conveying unit, while the treatment medium is effective on the material. This is definitely possible if the material is conducted in hanging loops. However, problems are encountered in removing the now fully shrunk and relaxed material from the hot treatment medium. If for this purpose the material is simply drawn off, for example, by means of a pair of pressure rolls, tensile stresses again occur in the material, nullifying a large portion of the attained shrinkage. This is true, in particular, if the treatment medium is water and the endless material must be pulled out of the water.

Therefore, in a further embodiment, the invention provides to associate a sieve drum preferably under a suction draft with the outlet of the conveying unit for the tensionless withdrawal and transfer of the endless material to an installation where the material if further treated or conveyed. This measure ensures with certainty the desired, tension-free discharge of the endless material after the heat treatment in the hot condition. The endless material should, if at all possible, still be cooled on this sieve drum, thus essentially eliminating the sensitivity to tensile forces during the subsequent discharge of the material from the sieve drum.

The conditions for an optimum shrinkage are not only the aforementioned, tension-free conveyance of the suspended loops through the treatment chamber, but also the maintenance of a certain residence time, the possibility of shrinking all flat surfaces of the material, i.e. also those areas disposed on the supporting rods, and the low-tension take-off of the web of material at the outlet of the shrinking device. To attain a sufficient length of the residence time, the apparatus must either be constructed of a sufficient length or the supporting rods must be arranged in close mutual adjacency. However, the production of a chain with closely spaced supporting rods is very expensive, since such chain must also run downwardly from the outlet and must be returned underneath the hanging loops to the inlet. It is therefore customary to arrange a compromise, but as a consequence the supporting rods in the region of the loops suspended therefrom have mutual spacings which are too large.

In a further development of the apparatus according to this invention, the endless conveyor is to consist, therefore, of a chain, the links of which are smaller than the spacing between the supporting rods, and the provision is made that in the zone of the fully formed suspended loops the chain is pushed together in the manner of an accordion, and thus the supporting rods are located at small mutual spacings, while the chain is stretched out in the zone where it is returned from the outlet.

This measure not only provides an optimum filling of a treatment bath of a certain size with a certain amount of material, but also facilitates the take-off of the shrunk web of material at the outlet of the apparatus with the side portions of a hanging loop in close mutual adjacency, because less liquid is present between such side portions, which liquid must escape toward the sides when a hanging loop is pulled open. Thus, less force will be required to pull a hanging loop open, whereby also less tension is exerted on the web of material.

In order to affect the shrinkage in the zone of the supporting rods, it is advantageous to move the supporting rods upwardly and downwardly, namely by a zigzag-shaped guidance over the length of the shrinking bath; for this purpose, the supporting rods are fashioned as an oblong eye in cross section and can be pushed in the upward and downward directions about their respective supporting journal [pin, trunnion.]. It is furthermore advantageous — as provided by this invention — to hold the pulled-together chain links in a guide rail, which latter is fashioned to be movable upwardly and downwardly. In this connection, the guide bars should pivot about an axis to superimpose on the upward and downward movements a rotary motion of the supporting rods. This is attained in accordance with this invention by a pivotal motion of the guide rail, wherein the pivoting joint of the guide rail should be arranged in the zone of the outlet of the apparatus. Thereby, the supporting rods will move upwardly and downwardly to a more vigorous extent in the zone of the inlet, namely at a location where the ability of the material to shrink is greatest.

Even though an upward floating of the hanging loops is prevented by the liquid flow in the treatment bath which is directed from the top toward the bottom, the lower ends of the loops are yet suspended in the bath so that they are oriented obliquely backwardly. This is due to the movement of the endless conveying means, where the hanging loops are drawn in the conveying direction in the upper zone, while the lower ends are retained in the liquid. Such an inclined positioning of the hanging loops cannot be prevented, either, by the introduction of liquid in the zone of the inlet.

In order to solve this problem in the apparatus of the present invention, another embodiment provides that additionally a further liquid cycle is provided in the treatment chamber, superimposed on the first-mentioned liquid cycle and oriented from the top toward the bottom, namely over the operating width from the inlet side toward the outlet side. Advantageously, the inlet is to be fashioned for this purpose as a funnel extending over the operating width, the liquid being fed to this funnel along both longitudinal sides by way of an overflow. The discharge point of the liquid is then provided underneath the outlet for the material in the zone of the bottom of the treatment chamber. By this measure, the liquid circulation at right angles to the longitudinal direction of the apparatus is superimposed by a liquid circulation in the longitudinal extension of the treatment chamber, oriented from the inlet toward the outlet from the top toward the bottom, i.e. diagonally through the treatment bath. The lower ends of the suspended loops are then maintained at the same level as the conveyor rods.

In order to attain the low-tension guidance of the material desired in total within the entire plant, a sieve drum washing machine is disposed upstream and downstream of the shrinking apparatus, as is conventional for a low-tension treatment. On this washing machine, the material is to be preliminarly rinsed prior to the shrinking step and is to be washed out after the shrinking treatment, which is preferably conducted with the material being carried on the drum in the form of folds.

The drawing shows several embodiments of a wet treatment apparatus, to wit:

Figure 1:
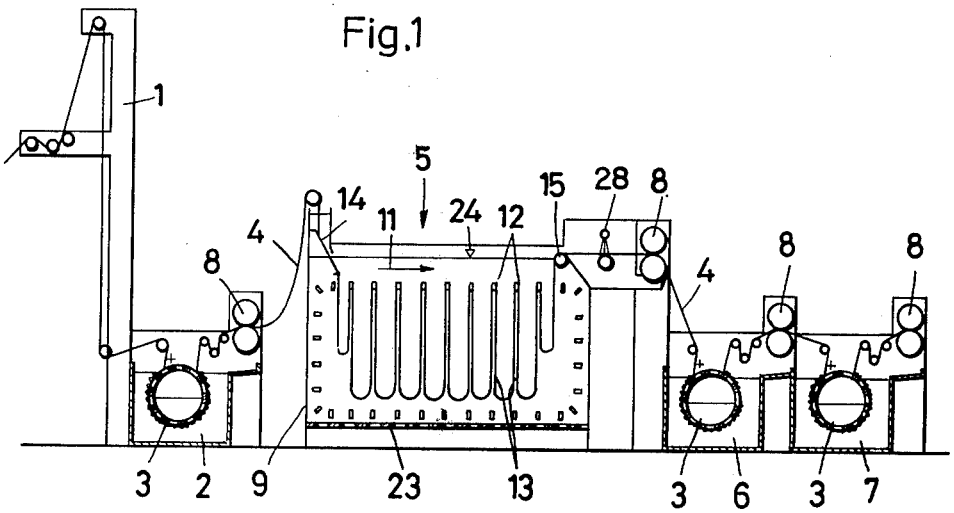
FIG. 1 shows a section longitudinally through a shrinking and washing plant.

The arrangement shown in FIG. 1 consists of a material delivery gallows 1, a sieve drum washing machine 2 for the preliminary rinsing of endless material 4 deposited in folds on the drum 3, a shrinking device denoted by 5 in its entirety, and subsequent sieve drum washing baths 6, 7 wherein the material is to be washed out, preferably likewise with the material 4 being disposed in folds on the drums 3. After each wet treatment step, the material is to be squeezed by means of a pair of pressure rolls 8.

The shrinking device 5 consists of a container 9, passed through by an endless conveyor 10 in the conveying direction 11 of the material. The endless conveyor 10 consists of a chain to which are attached supporting rods 12 at mutual spacings and extending transversely across the width. The web 4 of textile material is freely suspended in rather long hanging loops 13 from the supporting rods 12 and is transported in this loop form through the liquid bath 9 by means of the moving endless conveyor 10. The latter returns to the inlet, together with the supporting rods extending transversely across the operating width, underneath the suspended loops. At the inlet, the material 4 is placed on the supporting rods by way of a chute 14. At the outlet, a guide roller 15 is provided for take-off purposes; this roller will be described in detail below.

Figure 2:
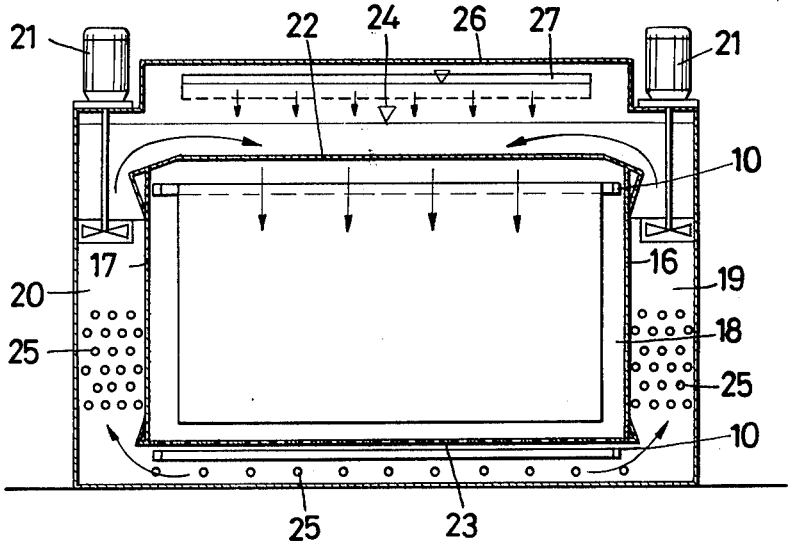
FIG. 2 shows a cross-sectional view of the apparatus of FIG. 1 with minor changes in structure.

FIG. 2 shows the more detailed construction of the shrinking bath. A treatment chamber 18 and two liquor recycling chambers 19, 20 are formed in the container by means of two partitions 16, 17. With the aid of pumps 21 controllable in their circulating power, a liquid current is generated within the container, as indicated by arrows. The current is produced so that it is oriented in the treatment chamber 18 from the top toward the bottom, and thus always aligns the loops 13 placed on the supporting rods 12 in the downward direction. In this connection, the current should only be so strong that the material is aligned. No tensile stress must be generated. It is also possible to have the pump operate in an intermittent fashion or to produce, by an attachment, a pulsating liquid flow which favorably affects the shrinking process.

In order to render the liquid current, effective from the top toward the bottom in the treatment chamber, uniform over the area of the treatment chamber, a screen cover 22 is disposed above the supporting rods 12. It is also possible to provide sprinkler boxes 27 above the level 24, fed by the pumps 21 and then distributing the liquid uniformly over the area. Also, a screen plate 23 is provided underneath the hanging loops 13, the passage [throughflow] resistance of which should be so large that absolutely no liquid flow can be produced which impedes the shrinking step. It is perhaps even advisable to make the resistance so strong that a second level is formed underneath the screen plate 23 in addition to the level 24 above the screen cover 22; this second level, however, is not illustrated in the drawing.

The device for heating the liquid is provided essentially in the liquor recycling chambers 19, 20. Underneath the screen plate 23, there should be merely a few pipes 25 passed through by heating medium, in order to prevent a disturbance of the downwardly oriented liquid current by the rising flow of the heated water. Suitably, the container 9 is closed off steam-tight on all sides by a lid 26, so that the water in the apparatus can be heated to the boiling point and optionally even somewhat above this temperature.

After passing through the shrinking apparatus, the material must be taken off from the supporting rods 12 without any tension. For this purpose, the guide roller 15 is provided which is still partially immersed in the liquor and withdraws the floating web of material from the liquid and immediately passes it on to a cooling device, indicated in FIG. 1 by a cold water spraying unit 28.

Figure 3:
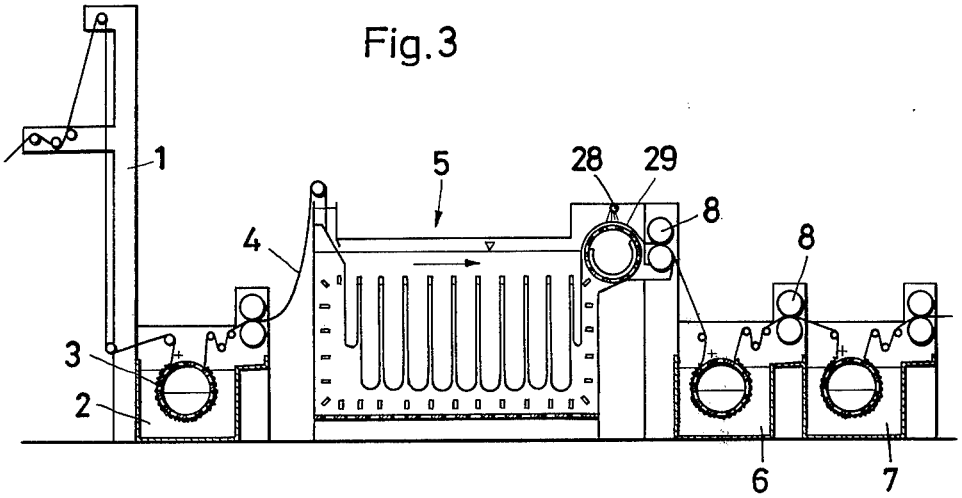
FIG. 3 shows the wet treatment plant of FIG. 1 wherein the suspended loop shrinking bath has a sieve drum at the outlet.

The shrinking apparatus of FIG. 3 corresponds to that of FIG. 1, but in this case the guide roller is fashioned as a sieve drum 29 where the medium flows from the outside toward the inside, the upper half of this sieve drum emerging from the liquor. The sieve drum 29 takes off the material floating in the liquid and thus being essentially weightless, and conveys this web of material without tension to the subsequently arranged pair of pressure rolls 8 which now no longer withdraws the material from the liquid, but merely squeezes the material. Advantageously, a cooling device is also associated in this case with the peripheral section of the sieve drum emerging from the bath, so that the endless material passes into the pair of squeezing rolls 8 in the cooled condition. The cooling device here again can consist of a cold water spraying unit 28.

Figure 4:
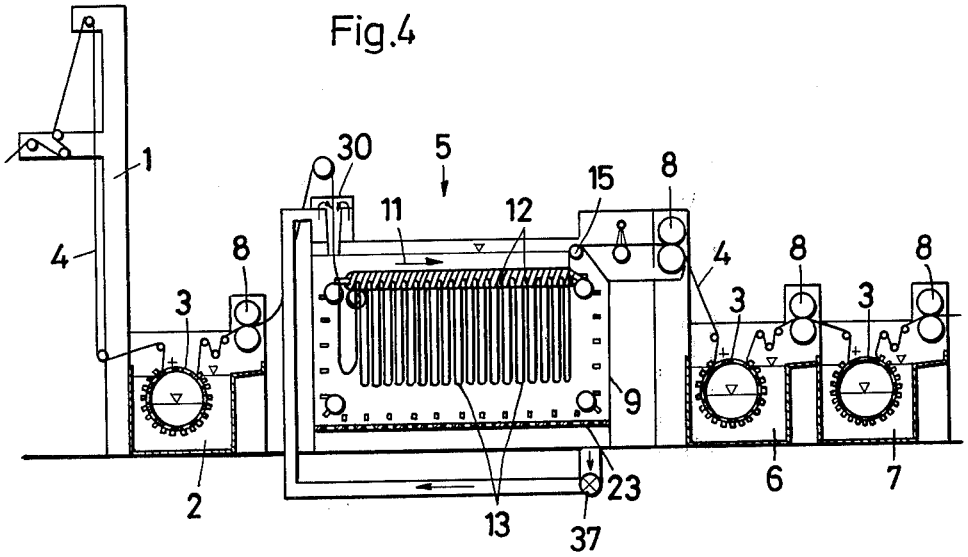
FIG. 4 shows the wet treatment plant of FIG. 1 with a suspended loop shrinking bath wherein the loops are closely spaced together.

The shrinking apparatus 5 of FIG. 4 likewise consists of a container 9, passed through by an endless conveyor 10 in the conveying direction 11 of the material. This endless conveyor 10, however, consists of a chain with several links to which are attached supporting rods 12 at equal spacings, but extending only partially transversely over the width. The textile web 4 is suspended in rather long hanging loops 13 freely from the supporting rods 12, which latter are provided directly adjacent to one another, and is transported in this loop form through the liquid bath 9 by means of the moving endless conveyor 10. The latter then returns to the inlet in the stretched condition with the supporting rods 12 underneath the hanging loops. At the inlet, the material 4 is placed on the supporting rods by way of an inlet gate 30. At the outlet, a guide roller 15 or a sieve drum 29 is provided for take-off purposes. Due to the fact that the supporting rods with the loops suspended therefrom are now arranged directly adjacent to one another, there is only a small amount of liquid between the loops. This enhances the low-tension take-off of the material, inasmuch as only little water needs to be discharged laterally while the loops are being pulled open, i.e. the resistance during the elimination of the loops is minor.

Figure 5:
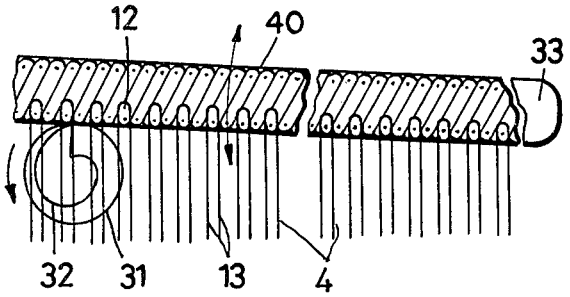
FIG. 5 shows the endless conveyor of FIG. 4 on an enlarged scale.

The chain 10, inseted in a guide rail 40 and placed in folds, can be seen especially from FIG. 5. It is advantageous, and essential for the shrinkage to be obtained, that the material is not firmly hung into the loops 13. To prevent this, a wheel 31 with an eccentric 32 is mounted to be rotatable in the zone of the inlet underneath the rail 30, moving the rail 40, which is arranged at the outlet to be pivotable about the axle 33, in the upward and downward directions. During the downward movement of the rail 40, the loops 13 will be temporarily floating within the liquor; in any event, the material will lift off from the supporting rods 12, namely to a greater extent in the zone of the inlet than at the outlet, where the shrinking step is essentially terminated. Furthermore, on the basis of this construction, the individual supporting rods 12 will turn to a minor extent relatively to the loops about the pivotal point [fulcrum] of the rail 40, so that also thereby a relative movement and thus an improved shrinkage are attained. The advantage of such a construction is the simple mechanics thereof by means of which all these motions are made possible.

Figure 6:
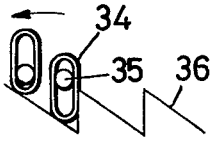
FIG. 6 shows a supporting rod of the conveyor according to FIG. 5 in a different embodiment.

According to FIG. 6, the supporting rods 12 are fashioned in cross section as an oblong eye 34. The supporting pins 35 of the endless conveyor 10 engage into the hollow space of the eye 34. By means of these supporting pins, the eye 34 and/or the supporting rods are freely displaceable in the upward and downward directions. This is made possible by conducting the supporting rods over a guide means 36 which has, for example, a zig-zag shape. The effect is the same as described in connection with FIG. 5.

In addition to the liquid circulation in the transverse direction of the shrinking apparatus with the aid of the pumps 21, a second circulation is illustrated in the device of FIG. 4, effective from the inlet at the top to the outlet at the bottom in the longitudinal direction of the shrinking apparatus. For this purpose, the liquid is removed by suction through a pump 37 at the bottom below the outlet, and is fed to the inlet gate 30. The inlet gate, for this purpose, consists of a funnel extending at right angles across the operating width, the liquid flowing downwardly over the upper edges of this funnel, moving together with the material 4. The thusproduced liquid current from the top toward the bottom diagonally in the longitudinal extension of the apparatus aligns the loops in the vertical direction. Otherwise, the loops would be aligned obliquely backwardly toward the inlet, which is caused inter alia by the movement of the chain in opposition to the stationary water.

What is claimed is:

1. An apparatus for the continuous wet treatment, especially shrinking, relaxing and/or bulking of endless material, including webs having an operating width, made of textured polyester fabric or knit which comprises a container for retaining a treatment liquor at a liquid level, said container having an inlet and an outlet for said endless material, an endless conveying means having support rods extending transversely across the width of the endless material within said container for transporting the material through the liquor in the form of suspended loops in an operating direction from the inlet to the outlet of the container, vertically disposed partition means positioned within said container for defining a treatment chamber having a top portion and a bottom portion and a liquid recycling chamber, said partition means having an upper portion and a lower portion, being spaced from an outer wall of the container and being arranged so that the treatment chamber and the recycling chamber are in communication with one another at the upper portion and at the lower portion of the partition means, means for producing a liquid circulation from the treatment chamber into the liquor recycling chamber, said liquor being directed from the top portion of the treatment chamber to the bottom portion of the treatment chamber, means for supplying heat to the liquor within said container and take-off means for removing the endless material from said liquor in a substantially tension-free manner, said take-off means being arranged at the outlet of said container and having a supporting surface positioned at the liquid level therein and means immediately adjacent and down-stream of said take-off means for cooling said liquor treated endless material to fix the volume of said material.

2. An apparatus according to claim 1, wherein said partition means comprises a wall member aligned in parallel to the operating direction of the endless conveying means.

3. An apparatus according to claim 1, wherein said partition means includes two wall members positioned from an outer wall of the container to form liquid recycling chambers on both sides of the treatment chamber.

4. An apparatus according to claim 1, wherein said means for producing a liquid circulation comprises a pump located within said liquor recycling chamber.

5. An apparatus according to claim 4, wherein said pump produces a pulsatng liquid flow within said treatment chamber.

6. An apparatus according to claim 1, wherein said treatment chamber is covered at the top portion located below the liquid level by a liquid-permeable plate means.

7. An apparatus according to claim 6, wherein said treatment chamber is provided at the bottom portion with a liquid-permeable plate means.

8. An apparatus according to claim 7, wherein the plate means arranged at the bottom portion of said treatment chamber has a throughflow resistance sufficiently large to provide a second liquid level beneath said plate means in addition to the liquid level present in said container above said plate means located at the top portion of said treatment chamber.

9. An apparatus according to claim 1, further comprising a steam-tight hood arranged above said container for closing off the container in a steam-type manner and for allowing the introduction of the endless material through the inlet and for discharge of the endless material through the outlet of said container.

10. An apparatus according to claim 1, wherein the heating means is arranged within said liquor recycling chamber.

11. An apparatus according to claim 1, wherein said heating means for supplying heat energy to the liquor includes heating devices essentially within the liquor recycling chamber and heating devices below the treatment chamber, a greater number of the heating devices being provided within said liquor recycling chamber.

12. An Apparatus according to claim 1, wherein said take-off means includes a guide roller having a portion that is immersed in said liquor and that is located below said liquid level.

13. An apparatus according to claim 1, wherein said take-off means includes a sieve drum means positioned closely adjacent to an end of said conveying means for effecting tension-free removal of the endless material from said conveying means and delivery of the endless material to another unit for effecting treatment of the material.

14. An apparatus according to claim 13, wherein said sieve drum means is arranged to remove the liquor from said endless material by means of a suction draft.

15. An apparatus according to claim 14, wherein said sieve drum means comprises a sieve drum partially immersed in the liquor and being arranged to carry the endless material on an upper portion of a conveying surface located outside of the liquor.

16. An apparatus according to claim 1, wherein said means for cooling said endless material comprises a cold water spraying means that is operatively associated with the take-off means of directing water on to the endless material.

17. An apparatus according to claim 1, wherein said endless conveying means comprises a chain having links which are smaller than the spacing between the supporting rods, the links of said chain being pushed together and in contact with each other during transportation of the fully formed hanging loops of the endless material across the treatment chamber, whereby the supporting rods are arranged on said links with small spaces therebetween and said links being extended when the chain is returned from the outlet to the inlet of said container.

18. an apparatus according to claim 17, wherein the chain links arranged closely adjacent to each other during transportation of the endless material in the form of loops is retained by a guide rail means which is arranged to be moveable upwardly and downwardly within said container.

19. An apparatus for the continuous wet treatment, especially for the shrinking, relaxing and/or bulking of endless material including webs having an operating width made of textured polyester fabric or knit, which comprises a container for retaining a treatment liquor at a liquid level therein, said container having an inlet and an oulet for said endless material, an endless conveying means having supporting rods extending transversely across the width of the endless material within said container for transporting the material through the liquor in the form of suspended loops from the inlet to the outlet of said container, a vertically arranged partition means positioned within said container for defining a treatment chamber and a liquor recycling chamber, with the endless conveying means being arranged within said treatment chamber and said chambers being in communication with one another above and below said partition means, and a first liquor circulating means arranged in said liquor recycling chamber for producing liquid circulation from said treatment-chamber to said liquor recycling chamber and for directing liquor from the top to the bottom of said treatment chamber, and a second liquor circulating means for superimposing another forced circulation of liquor from the top towards the bottom of said treatment chamber, said second superimposed circulation being directed across the container at a point adjacent to the inlet to a point below the outlet.

20. An apparatus according to claim 19, wherein the inlet is formed by a funnel extending over the operating width of the endless material, guide means for directing the endless material through said inlet, means for feeding liquor to this funnel on both longitudinal sides, including an overflow means and a discharge means for the liquor being provided, beneath the outlet through which the material is discharged, in a bottom portion of the treatment chamber.

21. An apparatus according to claim 20, wherein the discharge means in the bottom of the treatment chamber is connected to the inlet via a conduit having a pump located therein.

22. An apparatus according to claim 21, wherein at least one sieve drum means under a suction draft is disposed upstream and downstream of said treatment chamber.

* * * * *